US005887457A

United States Patent [19]

Yu

[11] Patent Number: 5,887,457

[45] Date of Patent: Mar. 30, 1999

[54] WASHING MACHINE

[75] Inventor: Jeong-Gi Yu, Incheon, Rep. of Korea

[73] Assignee: Daewoo Electronics Co., Ltd., Rep. of Korea

[21] Appl. No.: 865,677

[22] Filed: May 30, 1997

[30] Foreign Application Priority Data

Jun. 29, 1996 [KR] Rep. of Korea ..... 1996 25895

[51] Int. Cl.[6] ..... D06F 13/00

[52] U.S. Cl. ..... 68/23.7; 68/54; 68/79; 68/81; 68/92

[58] Field of Search ..... 68/23.6, 23.7, 68/38, 54, 63, 79, 80, 81, 92

[56] References Cited

U.S. PATENT DOCUMENTS

| | | | |
|---|---|---|---|
| 964,778 | 7/1910 | Hoglund | 68/38 |
| 2,149,987 | 3/1939 | Altorfer | 68/54 |
| 3,276,228 | 10/1966 | Ruiz | 68/38 X |
| 5,231,857 | 8/1993 | Rew et al. | 68/134 |

*Primary Examiner*—Philip R. Coe

*Attorney, Agent, or Firm*—Cushman Darby & Cushman Intellectual Property Group of Pillsbury Madison & Sutro, LLP

[57] ABSTRACT

A washing machine having a friction apparatus which can uniformly wash articles to be washed and can improve the washing efficiency. The friction apparatus is installed in openings formed at a side wall of a spin tub. Upper and lower slots are formed at upper and lower portions of the openings. The friction apparatus has a cylinder, a rod which extends through the cylinder, a plurality of blades which are integrally formed with an outer wall of the cylinder, and first and second bushings fixedly inserted into the upper and lower slots. An inner wall of the cylinder is formed with a spiral groove, and the rod is provided at its outer wall with a spiral strip which is engaged with the spiral groove. The friction apparatus fully makes contact with the articles while the washing cycle is being carried out thereby uniformly washing the articles and improving the washing efficiency.

10 Claims, 5 Drawing Sheets

WASHING MACHINE

BACKGROUND OF THE INVENTION

1. Field of the Invention

The present invention relates to a washing machine, and more particularly to a washing machine having a friction apparatus which not only can uniformly wash articles to be washed, but also can improve the washing efficiency.

2. Prior Arts

As is well known, a washing machine is an appliance for separating dirt from articles to be washed such as clothing by sequentially carrying out various cycles in the order of liquid feeding, washing, rinsing, dehydrating, and draining cycles.

While the above cycles are being executed, dirt contained in the articles separates from the articles by means of friction between a liquid flow and the articles or by means of detergents.

FIG. 5 shows such a conventional washing machine 500.

As shown in FIG. 3, conventional washing machine 500 includes a housing 510. An outer tub 520 for receiving a washing liquid is disposed in housing 510. Enclosed within outer tub 520 is a spin tub 530 formed at its side wall with a plurality of discharging holes 532. Below outer tub 520 but within housing 510, there are provided a motor 540 for generating a driving force, and a gear assembly 550 which transfers the driving force of motor 540 to spin tub 530 or to a pulsator 560 rotatably mounted on a bottom wall of spin tub 530.

While the washing cycle is being carried out, pulsator 560 driven by motor 540 rotates is formed and reverse directions, thereby creating a swirl-shaped liquid flow in spin tub 530. The swirl-shaped liquid flow collides with the articles in spin tub 530, so the articles are washed.

However, is conventional washing machine 500, the swirl-shaped liquid flows generated by pulsator 560 become weak as they reach an upper portion of spin tub 530 due to an interference by the articles. For this reason, when a large amount of articles are placed in spin tub 530, the washing effect at the upper portion of spin tub 530 is reduced. Particularly, articles having light weight are not completely immersed in the washing liquid, but float on the surface of the washing liquid in the direction of the liquid flow. As a result, the articles do not widely collide with the liquid flow, so the dirt contained in the articles is not completely separated from the articles.

In addition, since the detergent permeated in the articles is not completely dissolved in the washing liquid, the articles are not cleanly washed.

In order to solve the above problems, various washing machines have been suggested, but they have presented many problems.

For example, U.S. Pat. No. 5,231,857 issued to Rew et al. discloses a washing machine having a roller type agitator. In Rew's washing machine, the roller type agitator comprises at least one roller rotatably mounted on a rotator by means of a rotation shaft. In a washing operation, articles disposed in a spin tub directly makes contact with the rollers so that the articles are equally washed and so that a good washing effect can be obtained.

However, since the rollers are mounted on the rotator installed at a bottom wall of the spin tub, the rollers cannot make contact with the articles placed at an upper portion of the spin tub, so the washing effect at the upper portion of the spin tub is relatively reduced.

SUMMARY OF THE INVENTION

The present invention has been made to overcome the above described problems of the prior art, and accordingly, it is an object of the present invention to provide a washing machine which not only can uniformly wash articles to be washed, but also can improve the washing efficiency and solvency of the detergent.

To achieve the above object, the present invention provides a washing machine comprising:

- a housing;
- an outer tub for receiving a washing liquid, the outer tub being disposed in the housing;
- a spin tub formed at a side wall thereof with a plurality of discharging holes, the spin tub being disposed in the outer tub and having at the side wall thereof a plurality of rectangular openings which are regularly spaced apart from each other;
- a pulsator rotatably mounted on a bottom wall of the spin tub;
- a first means for generating a rotational force;
- a pulsator driving section for transferring the rotational force of the first means to the pulsator; and
- a second means for scrubbing an article to be washed, the second means being disposed in each rectangular opening.

According to a preferred embodiment, the first means includes a reversible motor.

The second means includes a cylinder having an inner wall forming a perforating hole, a rod which extends through the perforating hole, a plurality of blades which are integrally formed with an outer wall of the cylinder, and first and second bushings fixedly inserted into the first and second slots. First and second ends of the rod are fixedly inserted into first and second bushings, respectively.

The inner wall of the cylinder is formed with a spiral groove, and the rod is provided at an outer wall thereof with a spiral strip which is engaged with the spiral groove.

When the pulsator rotates in a forward direction, the articles placed in the spin tub move in a forward direction along the liquid flow. The articles moving along the liquid flow collide with the blades so that dirt contained in the articles to be washed is effectively removed from the articles.

In addition, by the collision with the articles moving in the forward direction, the blades are rotated in the first direction. As blades rotate in the first direction, the cylinder moves up along the spiral of the rod. Therefore, the articles disposed at the upper portion of the spin tub can make contact with the blades, so the washing effect at the upper portion of the spin tub can be improved.

When the pulsator rotates in a reverse direction, the articles moving along the liquid flow collide with the blades, thereby rotating the blades in the second direction which is opposite to the first direction. Accordingly, the washing effect at the lower portion of the spin tub can be improved.

The friction apparatus of the present invention fully makes contact with the articles while the washing cycle is being carried out, thereby uniformly washing the articles and improving the washing efficiency.

Furthermore, since the articles are scrubbed against the blades of the friction apparatus, the detergent deeply permeated in the articles is easily separated from the articles and is easily dissolved in the washing liquid; thereby further improving the washing efficiency.

BRIEF DESCRIPTION OF THE DRAWINGS

The above object and other advantages of the present invention will become more apparent by describing in detail a preferred embodiment with reference to the attached drawings, in which.

DESCRIPTION OF THE PREFERRED EMBODIMENTS

Hereinafter, preferred embodiments of the present invention will be described in detail with reference to the accompanying drawings.

Figure 1:
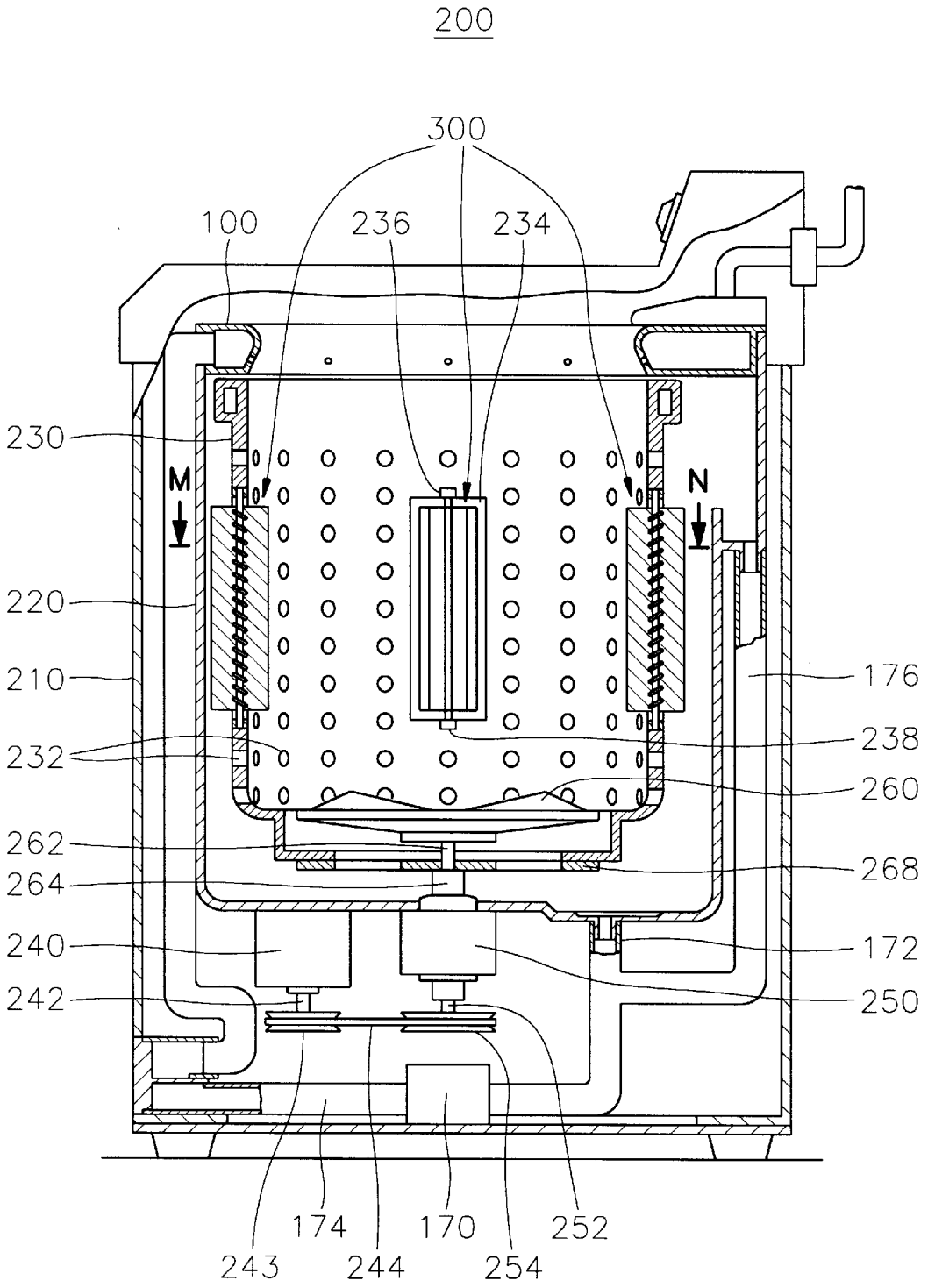
FIG. 1 is a sectional view showing the structure of a washing machine according to one embodiment of the present invention.

FIG. 1 shows a washing machine 200 according to one embodiment of the present invention.

As shown in FIG. 1, washing machine 200 includes a housing 210. An outer tub 220 for receiving a washing liquid is disposed in housing 210. Enclosed within outer tub 220 is a spin tub 230 formed at its side wall with a plurality of discharging holes 232.

Spin tub 230 is provided at its side wall with a plurality of openings 234 which are regularly spaced out apart from each other. According to a preferred embodiment of the present invention, openings 234 have a rectangular shape and four openings 234 which are spaced at an angle of 90 degrees apart from each other, are formed at the side wall of spin tub 230. Each opening 234 is formed at its upper and lower portions with upper and lower slots 236 and 23. Installed in each opening 234 is a friction apparatus 300 for improving a washing effect by scrubbing an article to be washed. The structure of friction apparatus 300 will be more detailedly described below with reference to FIGS. 2 to 4.

Disposed below outer tub 220 are a motor 240 generating a rotational force for operating washing machine 200, and a gear assembly 250 which receives the rotational force from motor 240 and then transmits the rotational force to spin tub 230 or to a pulsator 260 rotatably mounted on a bottom wall of spin tub 230. Pulsator 260 can be rotated in forward and reverse directions as indicated by arrows in FIG. 4.

According to a preferred embodiment of the present invention, motor 240 includes a reversible motor which periodically generates a rotational force in forward and reverse directions. When a washing cycle is being carried out, gear assembly 250 transmits the rotation force of motor 240 to pulsator 260 through a pulsator rotating shaft 262. In addition, when a dehydrating cycle is being carried out, gear assembly 250 transmits the rotation force of motor 240 to spin tub 230 through a connection member 264 and a rotating plate 268 which is fixedly attached to the underside of spin tub 230.

A spraying nozzle assembly 100 is mounted on an upper portion of outer tub 220 so as to spray the washing liquid onto the articles. A circulation pump 170 is disposed at a lower portion of housing 210. Circulation pump 170 is communicated with outer tub 220 so as to circulate the washing liquid into spraying nozzle assembly 100 or so as to drain the washing liquid out of washing machine 200, through a drain tube 174.

Motor 240 has a motor shaft 242 which is formed at its lower end with a first pulley 243. Gear assembly 250 has a rotating shaft 252 which is formed at its lower end with a second pulley 254. Second pulley 254 is connected to first pulley 243 by a belt 244 in such a manner that the rotational force of motor 240 can be transmitted to gear assembly 250.

In addition, circulation pump 170 has a pump motor (not shown) therein and is connected to outer tub 220 through a discharging tube 172 so as to receive the washing liquid from outer tub 220. Circulation pump 170 is also connected to spraying nozzle assembly 100 through a circulation tube 176 so that the circulated washing liquid is sprayed into spin tub 230.

Hereinafter, the structures of friction apparatuses 300 will be explained. Since friction apparatuses 300 have identical structures the description will be given with respect to the structure of one friction apparatus 300.

Figure 2:
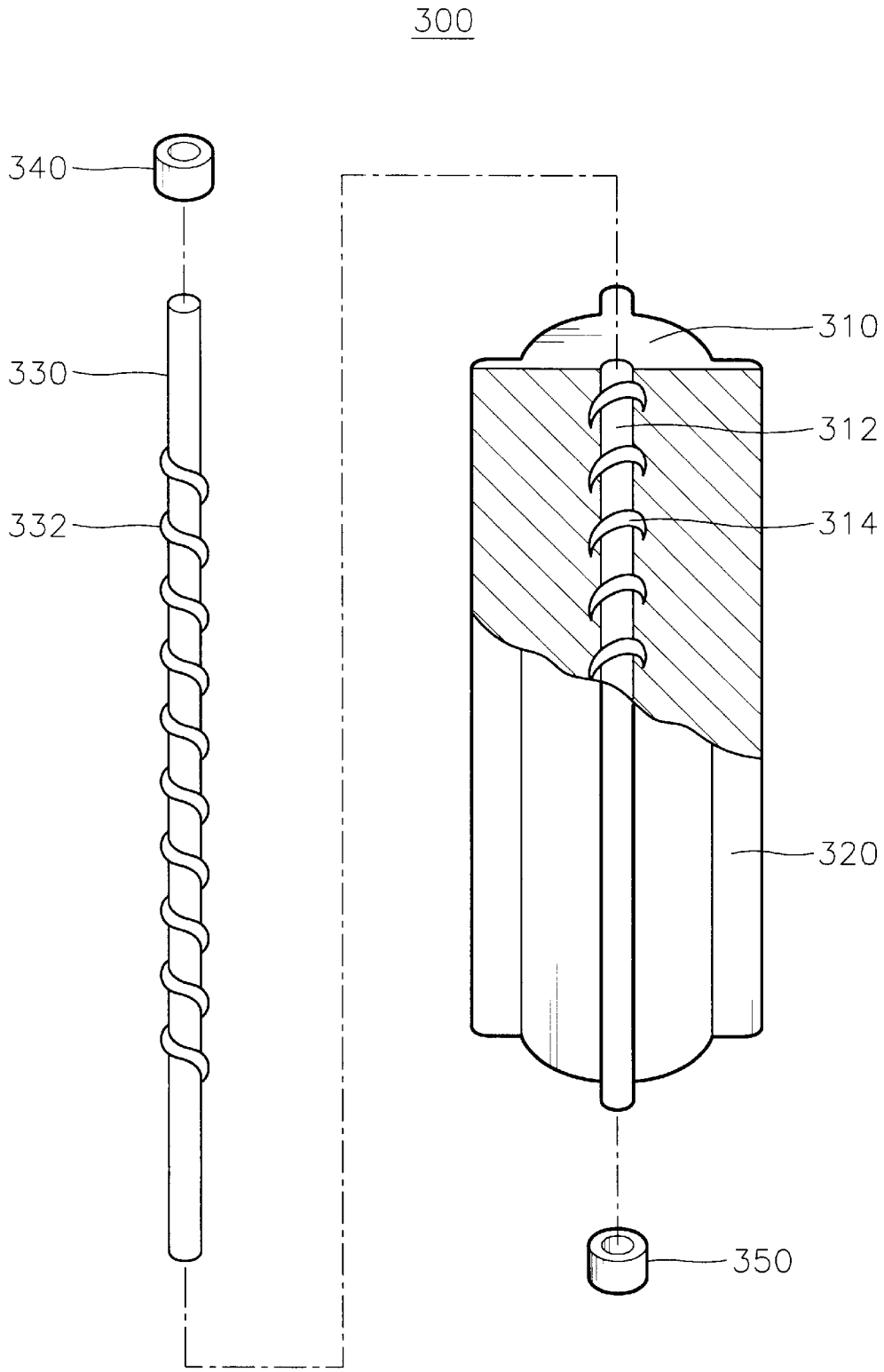
FIG. 2 is an exploded perspective view of a friction apparatus according to the first embodiment of the present invention.

FIG. 2 shows friction apparatus 300 according to the first embodiment of the present invention. Friction apparatus 300 comprises a cylinder 310 having an inner wall forming a perforating hole 312, and comprises a rod 330 which extends through perforating hole 312. At the inner wall of cylinder 110, there is formed a spiral groove 314. Rod 330 is provided at an outer wall thereof with a spiral strip 332 which is engaged with spiral groove 314. In the washing operation, cylinder 310 moves along spiral strip 332 of rod 330.

In addition, friction apparatus 300 further comprises a first busing 340 fixedly inserted into upper slot 236, and a second busing 350 fixedly inserted into lower slot 238. A first end of rod 330 is fixedly inserted into first busing 340, and a second end of rod 330 is fixedly inserted into second busing 350.

Figure 4:
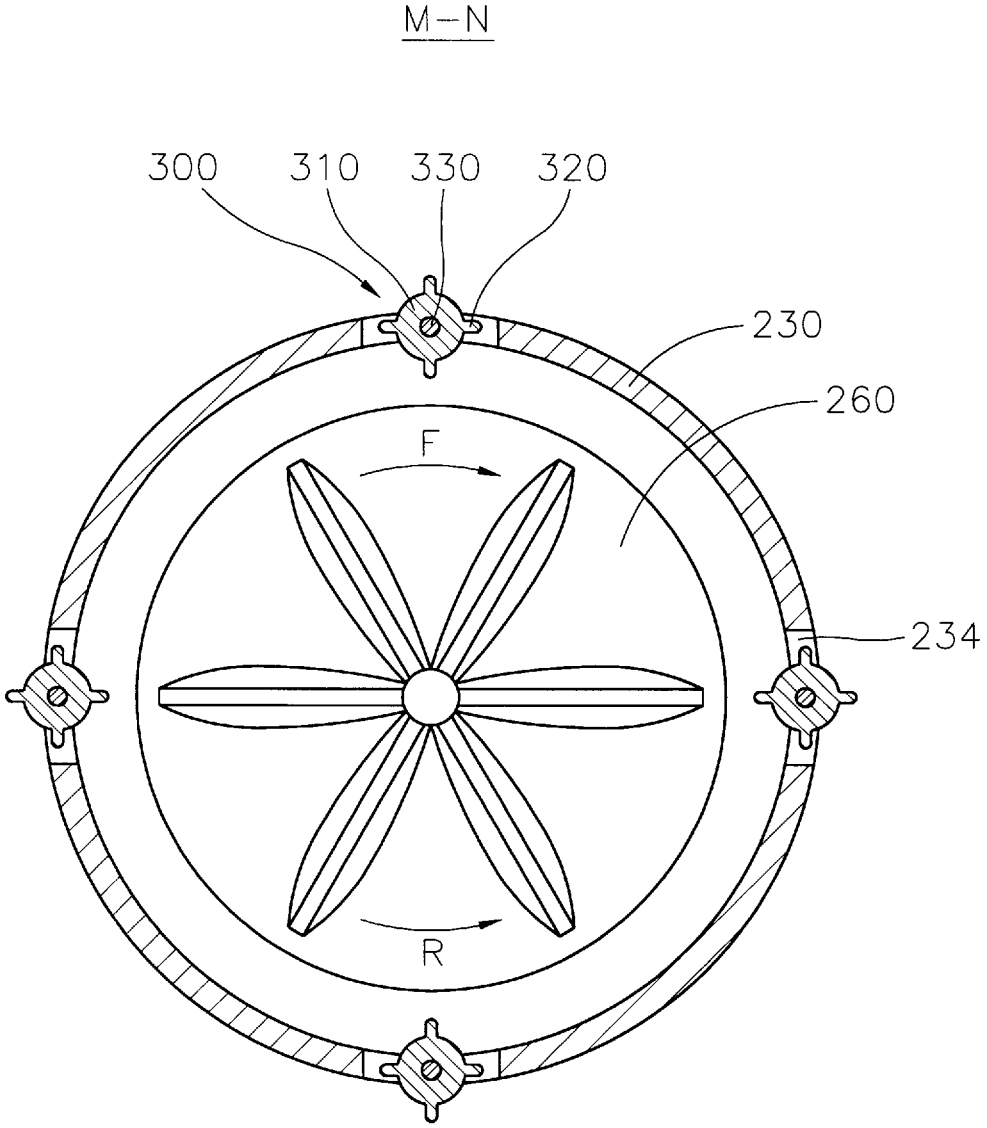
FIG. 4 is a sectional view taken along line M-N shown in FIG. 1.
Figure 5:
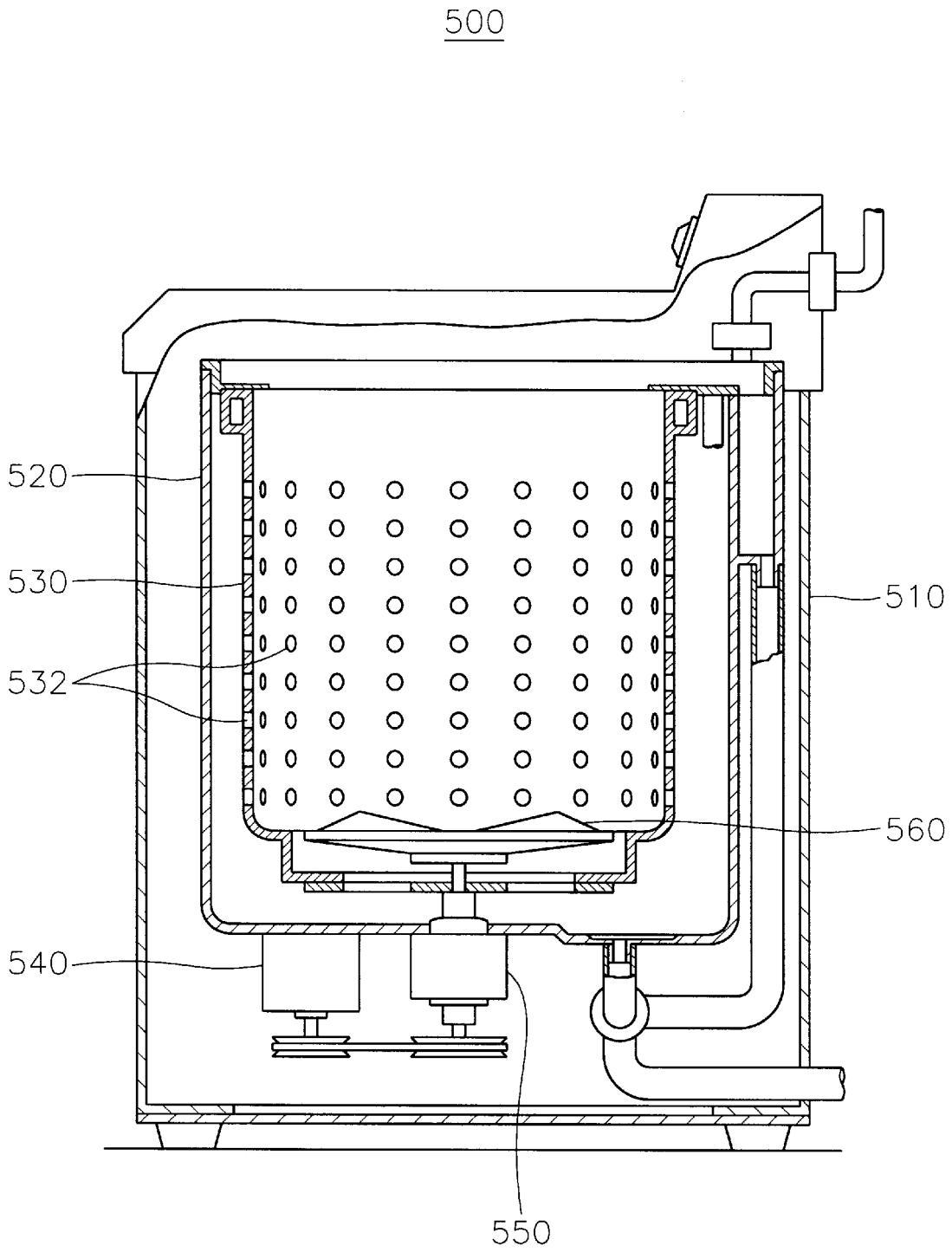
FIG. 5 (PRIOR ART)
FIG. 5 is a sectional view showing the structure of a conventional washing machine.

Referring to FIG. 4, cylinder 310 is provided at its outer wall with a plurality of blades 320 which are regularly spaced apart from each other in such a manner that they can make contact with the articles placed in spin tub 230. According to a preferred embodiment of the present invention, four blades, which are spaced at an angle of 90 degrees apart from each other, are integrally formed with the outer wall of cylinder 310. It is preferred to manufacture blades 320 by a flexible material having a predetermined elasticity so as to prevent the articles from being damaged.

In the assembling process, first and second bushings 340 and 350 are respectively and fixedly inserted into upper and lower slots 236 and 238. Then, the first and second ends of rod 330 are respectively and fixedly inserted into first and second bushings 340 and 350. Therefore, in order to easily assemble rod 330 into first and second bushings 340 and 350, it is preferred to manufacture blades 320 by a flexible material having a predetermined elasticity.

Figure 3:
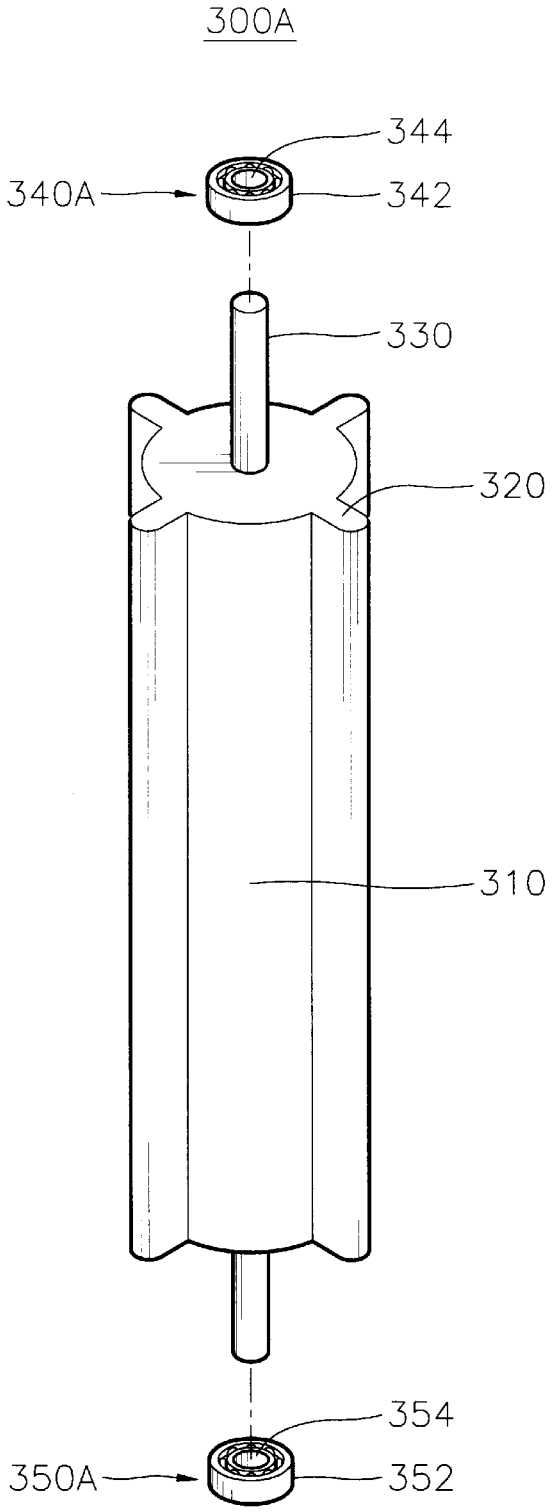
FIG. 3 is an exploded perspective view of a friction apparatus according to the second embodiment of the present invention.

FIG. 3 shows a friction apparatus 300A according to the second embodiment of the present invention. Friction apparatus 300A is similar to friction apparatus 300 of the first embodiment except for first and second ball bearings 340A and 350A which are, instead of first and second bushing 340 and 350, respectively inserted into upper and lower slots 236 and 238.

Outer rims 342 and 352 of first and second ball bearings 340A and 350A are fixedly installed in upper and lower slots 236 and 238, and inner rims 344 and 354, into which first and second ends of rod 330 are respectively inserted, can rotate.

In this embodiment, blades 320 can rotate at a higher speed, so the washing effect is further improved.

According to another embodiment of the present invention, all of rod 330, cylinder 330 and blades 320 can be integrally formed. In this case, the friction apparatus can be easily manufactured and can be easily assembled into the side wall of spin tub 230.

Washing machine 200 having the construction as described above operates as follows.

Firstly, when a user pushes an operating button installed on a control panel, the washing liquid is introduced from a liquid source into outer tub 220 until a liquid level in outer tub 220 reaches a predetermined level.

Then, when the liquid level in outer tub 220 reaches the predetermined liquid level, a liquid feed control valve blocks a liquid feeding pipe, so the washing liquid stops being supplied into outer tub 220. At the same time, motor 240 rotates in the forward and reverse directions. The rotational force of motor 240 is transmitted to pulsator 260 by way of motor shaft 242, first pulley 243, belt 244, second pulley 254, gear assembly 250, and pulsator driving shaft 262. As a result, pulsator 260 rotates in forward and reverse directions F and R, thereby generating the swirl-shaped liquid flow in spin tub 230.

When pulsator 260 rotates in forward direction F, the articles placed in spin tub 230 move in forward direction F along the liquid flow. The articles moving along the liquid flow collide with blades 320 of friction apparatus 300 so that dirts contained in the articles are effectively removed from the articles. In addition, since the articles are scrubbed against blades 320 of friction apparatus 300, the detergent deeply permeated in the articles is easily separated from the articles and is easily dissolved in the washing liquid, thereby further improving the washing efficiency.

In addition, by the collision with the articles moving in forward direction F, blades 320 of friction apparatus 300 is rotated in the first direction. As blades 320 rotate in the first direction, cylinder 310 integrally formed with blades 320 moves up along spiral strip 332 of rod 330. Therefore, the articles disposed at the upper portion of spin tub 230 can make contact with friction apparatus 300, so the washing effect at the upper portion of spin tub 230 can be improved.

When pulsator 260 rotates in reverse direction R, the articles placed in spin tub 230 move in reverse direction R along the liquid flow. The articles moving along the liquid flow collide with blades 320 of friction apparatus 300, thereby rotating blades 320 of friction apparatus 300 in the second direction which is opposite to the first direction. As blades 320 rotate in the second direction, cylinder, cylinder 310 integrally formed with blades 320 moves down along spiral strip 332 of rod 330. Therefore, the articles disposed at the lower portion of spin tub 230 can make contact with friction apparatus 300, so the washing effect at the lower portion of spin tub 230 can be improved.

The above action of friction apparatus 300 is continuously carried out while the washing cycle is being executed, so the articles are uniformly washed.

In addition, while the washing cycle is being carried out, circulation pump 170 operates according to a predetermined algorithm, so some of the washing liquid that has been introduced into outer tub 220 is discharged from outer tub 220 into circulation pump 170 through discharging tube 172. Upon receiving the washing liquid, circulation pump 170 compresses the washing liquid and circulates the washing liquid through circulation tube 176 into spraying nozzle assembly 100 mounted on the upper portion of outer tub 220. Spraying nozzle assembly 100 strongly sprays the circulated washing liquid onto the articles in spin tub 230, thereby further improving the washing effect.

When the washing cycle has finished, the pump motor rotates in the reverse direction. At this time, a first valve disposed between circulation pump 170 and circulation tube 176 is closed, and a second valve disposed between circulation pump 170 and drain tube 174 is opened. Accordingly, the washing liquid filled in outer tub 220 is drained out of washing machine 200 by way of discharging tube 172, circulation pump 170, and drain tube 174.

As described above, the friction apparatus of the present invention fully makes contact with the articles while the washing cycle is being carried out, thereby uniformly washing the articles and improving the washing efficiency.

Furthermore, since the articles are scrubbed against the blades of the friction apparatus, the detergent deeply permeated in the articles is easily separated from the articles and is easily dissolved in the washing liquid, thereby further improving the washing efficiency.

While the present invention has been particularly shown and described with reference to preferred embodiments thereof, it will be understood by those skilled in the art that various changes in form and detail may be effected therein without departing from the spirit and scope of the invention as defined by the appended claims.

What is claimed is:

1. A washing machine comprising:

a housing;

an outer tub for receiving a washing liquid, the outer tub being disposed in the housing;

a spin tub formed at a side wall thereof with a plurality of discharging holes, the spin tub being disposed in the outer tub and having at the side wall thereof a plurality of rectangular openings which are regularly spaced apart from each other;

a pulsator rotatably mounted on a bottom wall of the spin tub;

a first means for generating a rotational force;

a pulsator driving section for transferring the rotational force of the first means to the pulsator; and a second means for scrubbing an article to be washed, the second means being disposed in each rectangular opening and moving up and down within the rectangular opening.

2. The washing machine as claimed in claim 1, wherein the first means includes a reversible motor.

3. The washing machine as claimed in claim 1, wherein the side wall of the spin tub is formed with four rectangular openings which are spaced at an angle of 90 degrees apart from each other, the second means being installed in each of four rectangular openings.

4. A washing machine comprising:

a housing;

an outer tub for receiving a washing liquid, the outer tub being disposed in the housing;

a spin tub formed at a side wall thereof with a plurality of discharging holes, the spin tub being disposed in the outer tub and having at the side wall thereof a plurality of rectangular openings which are regularly spaced apart from each other, each rectangular opening being formed at upper and lower portions thereof with first and second slots, respectively;

a pulsator rotatable mounted on a bottom wall of the spin tub;

a first means for generating a rotational force;

a pulsator driving section for transferring the rotational force of the first means to the pulsator; and a second means for scrubbing an article to be washed, the second means being disposed in each rectangular opening.

5. The washing machine as claimed in claim 4, wherein the second means includes a cylinder having an inner wall forming a perforating hole, a rod which extends through the perforating hole, a plurality of blades which are integrally formed with an outer wall of the cylinder, and first and second ball bearings fixedly inserted into the first and second slots, first and second ends of the rod being rotatably inserted into first and second ball bearings, respectively.

6. The washing machine as claimed in claim 5, wherein the cylinder, the rod, and the blades are integrally formed with each other.

7. The washing machine as claimed in claim 4, wherein the second means includes a cylinder having an inner wall forming a perforating hole, a rod which extends through the perforating hole, a plurality of blades which are integrally formed with an outer wall of the cylinder, and first and second bushings fixedly inserted into the first and second slots, respectively, first and second ends of the rod being fixedly inserted into first and second bushings, respectively.

8. The washing machine as claimed in claim 7, wherein the inner wall of the cylinder is formed with a spiral groove, and the rod is provided at an outer wall thereof with a spiral strip which is engaged with the spiral groove.

9. The washing machine as claimed in claim 7, wherein the cylinder and the blades are made of a flexible material having a predetermined elasticity for preventing the article from being damaged.

10. The washing machine as claimed in claim 7, wherein the rod is made of a flexible material having a predetermined elasticity.

* * * * *